US006050255A

United States Patent [19]

Sievert

[11] Patent Number: 6,050,255

[45] Date of Patent: Apr. 18, 2000

[54] SPLITTER BLADE ASSEMBLY AND STATION

[75] Inventor: Dick J. Sievert, *deceased, late of* New Richmond, Wis., *by* Sandra E. Sievert, *executrix*

[73] Assignee: Anchor Wall Systems, Inc., Minnetonka, Minn.

[21] Appl. No.: 09/016,347

[22] Filed: Jan. 30, 1998

Related U.S. Application Data

[63] Continuation-in-part of application No. 08/807,264, Feb. 28, 1997, which is a continuation-in-part of application No. 08/774,247, Nov. 8, 1996.

[51] Int. Cl.[7] ..... B28D 1/32

[52] U.S. Cl. ..... 125/23.01; 125/24; 125/41

[58] Field of Search ..... 125/12, 16.04, 125/18, 23.01, 23.02, 24, 35, 40, 41; 225/97

[56] References Cited

U.S. PATENT DOCUMENTS

| | | | |
|---|---|---|---|
| 433,785 | 8/1890 | Harding . | |
| 787,199 | 4/1905 | Lloyd . | |
| 806,951 | 12/1905 | Bryning | 125/18 |
| 831,077 | 9/1906 | Johnson . | |
| 1,219,127 | 3/1917 | Marshall . | |
| 1,287,055 | 12/1918 | Lehman . | |
| 1,465,608 | 8/1923 | McCoy . | |
| 1,523,710 | 1/1925 | Pfeiffer . | |
| 1,534,353 | 4/1925 | Besser . | |
| 1,557,946 | 10/1925 | Smith . | |
| 1,751,028 | 3/1930 | Caswell et al. . | |
| 1,872,522 | 8/1932 | Stuckey . | |
| 1,893,430 | 1/1933 | McKenzie . | |
| 1,993,291 | 3/1935 | Vermont . | |
| 2,011,531 | 8/1935 | Tranchell . | |
| 2,121,450 | 6/1938 | Sentrop . | |
| 2,219,606 | 10/1940 | Van Schoick . | |
| 2,570,384 | 10/1951 | Russell . | |
| 2,593,606 | 4/1952 | Price . | |
| 2,881,753 | 4/1959 | Entz . | |
| 2,925,080 | 2/1960 | Smith . | |

(List continued on next page.)

FOREIGN PATENT DOCUMENTS

| | | |
|---|---|---|
| 2744/26 | 10/1927 | Australia . |
| 528788 | 5/1954 | Belgium . |
| 0 490 534 A2 | 6/1992 | European Pat. Off. . |
| 0 649 714 A1 | 4/1995 | European Pat. Off. . |
| 456776 | 4/1950 | Italy . |
| 215196 | 12/1989 | New Zealand . |
| 248234 | 3/1926 | United Kingdom . |
| 420667 | 12/1934 | United Kingdom . |
| 944066 | 12/1963 | United Kingdom . |
| 970595 | 9/1964 | United Kingdom . |
| 2 213 095 | 8/1989 | United Kingdom . |

OTHER PUBLICATIONS

"Besser Parts & Equipment", Catalog from Besser Company, Alpena, Michigan, pp. 1–22 (date unknown).

"Besser Concrete Paving Stones", Catalog from Besser Company, Alpena, Michigan, pp. 1–24 (date unknown).

Purchase Order for Kawano Cement Kogyo, Yamaguchi Ken, Japan, pp. 1–5 (date unknown).

*Primary Examiner*—Timothy V. Eley
*Attorney, Agent, or Firm*—Merchant & Gould P.C.

[57] ABSTRACT

A splitter blade assembly adapted to form split faces on concrete masonry units including: a plurality of blade sections arranged to bound an opening; and a stop positioned within the opening so as to prevent debris from lodging in the opening during a splitting operation.

24 Claims, 11 Drawing Sheets

U.S. PATENT DOCUMENTS

| | | | |
|---|---|---|---|
| 3,185,432 | 5/1965 | Hager, Jr. . | |
| 3,204,316 | 9/1965 | Jackson . | |
| 3,378,885 | 4/1968 | Dart . | |
| 3,392,719 | 7/1968 | Clanton et al. . | |
| 3,932,098 | 1/1976 | Huber et al. . | |
| 3,936,989 | 2/1976 | Hancock . | |
| 3,940,229 | 2/1976 | Hutton . | |
| 3,981,953 | 9/1976 | Haines . | |
| 4,023,767 | 5/1977 | Fontana . | |
| 4,098,865 | 7/1978 | Repasky . | |
| 4,114,773 | 9/1978 | Sekiguchi . | |
| 4,207,718 | 6/1980 | Schaaf et al. . | |
| 4,218,206 | 8/1980 | Mullins . | |
| 4,238,105 | 12/1980 | West . | |
| 4,250,863 | 2/1981 | Gagnon et al. . | |
| 4,335,549 | 6/1982 | Dean, Jr. . | |
| 4,659,304 | 4/1987 | Day . | |
| 4,745,720 | 5/1988 | Taylor . | |
| 4,784,821 | 11/1988 | Lépold . | |
| 4,802,836 | 2/1989 | Whissell . | |
| 4,848,309 | 7/1989 | Alderete | 125/40 |
| 4,869,660 | 9/1989 | Ruckstuhl . | |
| 4,896,472 | 1/1990 | Hunt . | |
| 4,909,717 | 3/1990 | Pardo . | |
| 5,017,049 | 5/1991 | Sievert . | |
| 5,062,610 | 11/1991 | Woolford et al. . | |
| 5,066,070 | 11/1991 | Clarke | 125/40 X |
| 5,078,940 | 1/1992 | Sayles . | |
| 5,139,721 | 8/1992 | Castonguay et al. . | |
| 5,161,918 | 11/1992 | Hodel . | |
| 5,217,630 | 6/1993 | Sayles . | |
| 5,249,950 | 10/1993 | Woolford . | |
| 5,261,806 | 11/1993 | Pleasant . | |
| 5,294,216 | 3/1994 | Sievert . | |
| 5,353,569 | 10/1994 | Rodrique . | |
| 5,484,236 | 1/1996 | Gravier . | |
| 5,490,363 | 2/1996 | Woolford . | |
| 5,653,558 | 8/1997 | Price . | |
| 5,662,094 | 9/1997 | Giacomelli | 125/40 X |
| 5,688,079 | 11/1997 | Bolduc et al. . | |
| 5,704,183 | 1/1998 | Woolford . | |
| 5,722,386 | 3/1998 | Fladgard et al. | 125/40 X |

SPLITTER BLADE ASSEMBLY AND STATION

This patent application is a continuation-in-part of U.S. patent application Ser. No. 08/807,264, filed Feb. 28, 1997 which is a continuation-in-part of U.S. patent application Ser. No. 08/774,247, filed Nov. 8, 1996.

BACKGROUND

The process of splitting away a portion of a concrete masonry unit to provide a decorative "rockface" to the finished unit is well-known. In the case where the finished rockface is planar, it has not been uncommon to provide a linear splitting groove or pattern on the uppermost surface of the pre-split unit to aid in the splitting process.

Anchor Wall Systems, Inc. ("AWS"), my assignee, forms a faceted or "three-way" split face on some of its concrete retaining wall units. The process first requires that a pre-split concrete masonry unit be formed by a block machine. The pre-split unit must be larger than the finished unit, so that a portion of it can be split away to form the decorative face. If the block machine is large enough, the pre-split unit comprises what will ultimately be two retaining wall blocks, joined face-to-face. Otherwise, the pre-split unit comprises the finished unit with a sacrificial portion joined to its face. Some of the AWS retaining wall units, such as the ANCHOR WINDSOR STONE®, ANCHOR DIAMOND®, and DIAMOND PRO™, are formed with lips to facilitate the locating of the blocks in a wall. Since the block machine forms the units on flat, horizontal metal pallets, the pre-split units are cast with the lips facing up.

After a pre-split unit is formed in the block machine, it is hardened by any one of a variety of curing techniques, until it has attained a suitable hardness for splitting. It is then split in a splitting machine. The unit is carried into the splitting station on a roller conveyor. It is supported there by a divided receiving plate. The splitting is typically accomplished with a top knife, which is driven down onto the pre-split unit, in combination with an opposed bottom knife and opposed side knives.

In the case of the three-way split, the top and bottom knives are formed in the shape of a "crow's foot", comprising a straight center section joining two diverging V-shaped portions. Up until now, AWS has molded vertical splitting grooves, which define the rearward edges of the return facets on the finished units, into the sides of the pre-split units. The side knives engage these grooves during the splitting process.

Heretofore, AWS has not formed any type of splitting groove or pattern into the top surface of a presplit unit which is to be split to form faceted faces on the finished units, and, in particular, has not formed any such patterns by the compressive action of a stripper shoe plate carrying appropriate tooling.

I have noted several shortcomings of the current system. It is difficult to create a face with an extended straight section and relatively short returns, particularly on the taller products. For example, AWS' current ANCHOR WINDSOR STONE® product is a four inch high block, twelve inches wide. The center section of the face is eight inches wide and the return sections are each two inches wide in front projection. AWS' current ANCHOR DIAMOND® product is a six inch high block. The center section of the face is eight inches wide and the return sections are each four inches wide in front projection. AWS has not experienced unusual difficulty in splitting these faces to the stated proportions if side knives are employed in combination with a top knife. However, AWS would like to increase the length of the center section of the ANCHOR DIAMOND® block to twelve inches, with approximately two inch returns (front projections). AWS has experienced difficulty in consistently splitting off such small wedges from the six inch tall product with standard automated splitting equipment. If the return splits are not acceptable, then the blocks must be manually dressed to make them acceptable, which increases the labor costs.

AWS would also like to minimize the need to use side knives, especially during the splitting of the ANCHOR WINDSOR STONE® product. This is because elimination of the side knives would permit the manufacturer to position two pre-split units in the splitter side-by-side, and thus create four split units with one stroke of the splitter.

Another problem is that as the block gets taller, it gets more difficult to get good return splits, regardless of how long the wedge is. For example, AWS' DIAMOND PRO™ blocks are eight inch tall products. The center section of the face of each is twelve inches wide, and the returns are three inches wide in front projection. It is difficult to consistently split the three inch wide returns on these products using conventional equipment and techniques.

SUMMARY OF THE INVENTION

I have found that I can improve the three-way splitting of our retaining wall products if I form a splitter guide pattern in the top surface of the pre-split concrete masonry unit. The guide pattern comprises a splitting groove which corresponds in length and orientation with the intended plane of the center section(s) of the face(s) of the finished unit(s), and recessed regions generally corresponding in size and orientation with the top plan of the wedges of material that need to be split from the pre-split units to create the return sections of the face(s) of the finished unit(s).

In the case of a pre-split unit comprising two identical finished units joined face-to-face, the splitting groove is formed transversely of the longitudinal axis of the unit, and along an axis of symmetry of the top surface of the pre-split unit. The splitting groove intersects recessed areas at each side edge of the top surface of the pre-split unit.

The splitting pattern is formed in the pre-split unit by the compressive action of the stripper shoe plate during the molding action of the block machine. Appropriate raised surfaces are formed on the plate to form the pattern.

DETAILED DESCRIPTION

The pre-split concrete masonry units are preferably formed in a conventional block machine, such as the V3/12 and DYNAPAC model machines, produced by Besser Co. of Alpena, Mich., and then are cured. The ANCHOR WINDSOR STONE® pre-split units may be formed generally as described in U.S. Pat. No. 5,249,950, which is incorporated herein by reference. The ANCHOR DIAMOND® and DIAMOND PRO™ pre-split units may be formed generally as described in U.S. Pat. No. 5,062,610, which is incorporated herein by reference.

Figure 1:
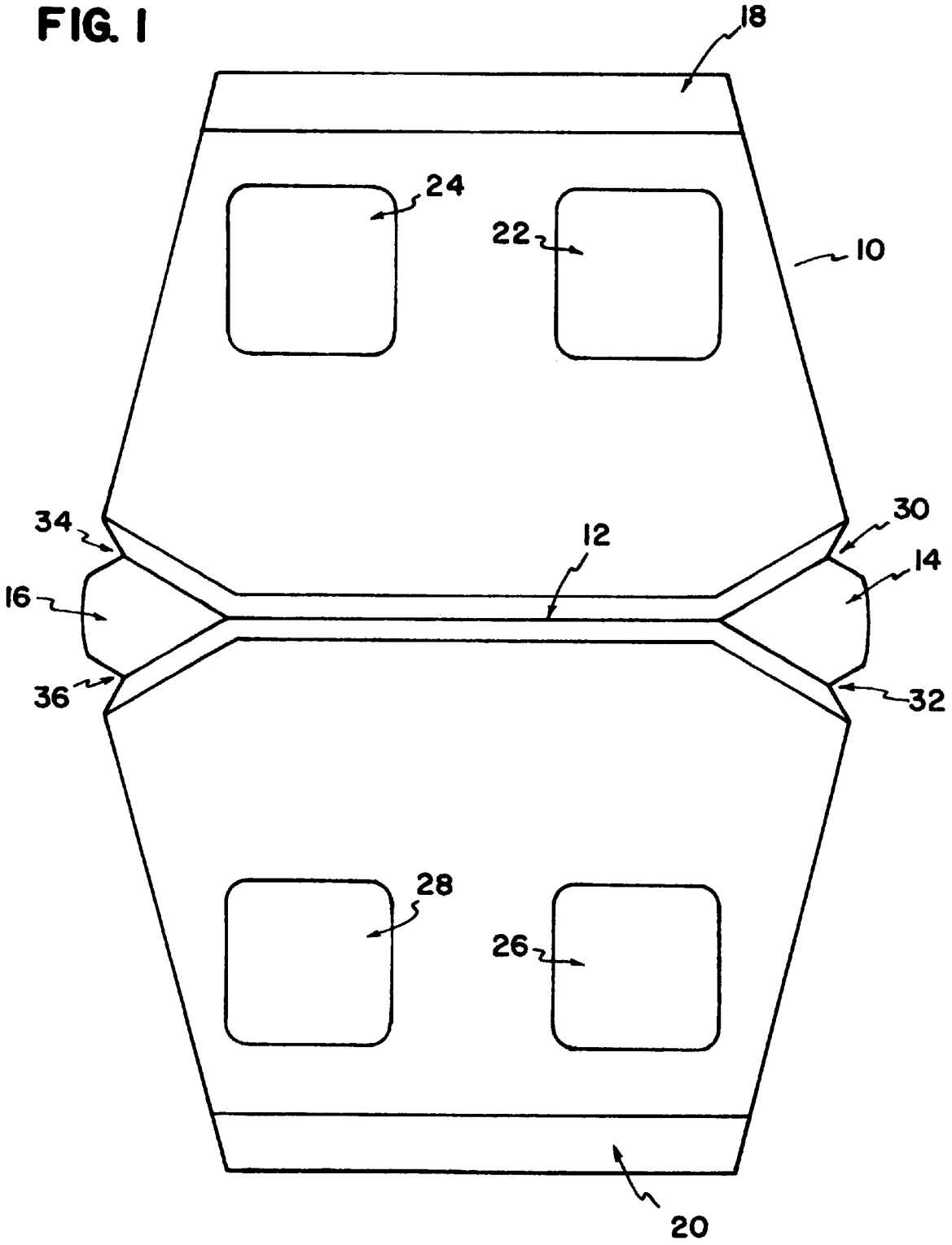
FIG. 1 is a plan view of the top, or "lips-up", side of a pre-split concrete masonry unit, (CMU), according to one aspect of my invention.

The process as described in the aforesaid patents is modified by forming a splitting pattern on the top, or "lips-up", surface of the pre-split concrete masonry unit ("CMU"). A CMU according to my invention is shown at reference numeral 10 in FIG. 1. As shown in FIG. 1, the splitting pattern comprises a transverse splitting groove 12, which intersects the two triangular-shaped recessed regions 14 and 16. The pattern is formed in the pre-split unit by the compressive action of the stripper shoe plate on the compacted mix held in the mold box. Appropriate raised surfaces are affixed to the face of the stripper shoe plate to accomplish this compressive, pattern forming action. Preferably, the depth of the splitting pattern on the pre-split unit is between ¼ inch and 1 inch, and more preferably is between ¼ inch and ½ inch. Other features of the CMU 10 are a pair of lips 18 and 20 integrally formed at the opposite ends of the top surface of the CMU, cores 22, 24, 26, and 28, and side grooves 30, 32, 34, and 36.

In the preferred embodiment, splitting grooves 12, 30, 32, 34, and 36 are V-shaped grooves, with side walls each oriented at about forty-five degrees from the horizontal, so that they intersect at an angle of about ninety degrees. In the regions of the recessed areas 14 and 16, where the splitting groove diverges, the side walls of the groove continue the same angular orientation, to provide clearance for the splitter blade, which is preferably formed with a sixty degree working edge.

The splitting may be accomplished in a splitting machine, such as those available from the Lithibar Matik company of Holland, Mich. I prefer to cure the pre-split CMU to a compressive strength of about between about 800 and 1750 psi, and more preferably, between about 1000–1200 psi. I adjust the splitting pressure in accordance with the standard skill in the art. I also prefer to use side knives and a bottom knife. In the case of the CMU 10, I prefer to have side knives contact the unit at the four side grooves 30, 32, 34, and 36, just prior to the stroke of the top knife and the bottom knife, which is a mirror image of the top knife. The bottom knife intersects the bottom surface of the CMU in planes corresponding to those intersected on the top surface by the top knife.

I have found that the technique works with symmetric pre-split units which will create two essentially identical finished units. This type of pre-split unit is shown in FIG. 1.

I have also found that the technique works with symmetric pre-split units which will create four essentially identical finished units. This type of pre-split unit is shown at reference numeral 100 in FIGS. 2A and 2B. Unit 100 is essentially two of the units 10 attached side-by-side by means of web 110 (without cores). Web 110 is preferably formed of the same composite fill material used to form the remainder of the CMU, and is formed during the molding process. The top, or "lips-up", surface of the web is recessed in the same manner as previously described with respect to the triangular-shaped recesses 14 and 16 shown in FIG. 1, shown as 114 and 116 in FIG. 2A. Again block lips are seen at 118 and 120. When CMU 100 is aligned in the splitter, with appropriate splitter blades, it will yield four finished units with each stroke of the splitter.

When splitting CMU 100, it is preferred to use top and bottom knives as previously described, and opposed side knives at the outside grooves 130, 132, 134, and 136. No side knives are used at the inside grooves 138, 140, 142, and 144. I have found that recessing the top surface of the attaching web 110 produces a good quality split on these inside edges without the necessity of side knives, which requires minimal, if any hand dressing.

I have also found that in the case of blocks having a height of about 4 inches or less, I can successfully produce a split unit with one stroke of the splitter when I employ the web 110, even without the splitter groove 112, and the compressed web and wedge regions. A presplit unit of this configuration is shown in FIG. 2B. As can be seen in FIG. 2B, through the process and apparatus previously described, side knives 440, FIG. 12, may be positioned adjacent outside grooves 130, 132, 134, and 136. When properly aligned in the splitter, with appropriate splitter blades, the splitting action will yield four substantially equally proportioned finished units with a single stroke of the splitting blade.

Figure 2A:
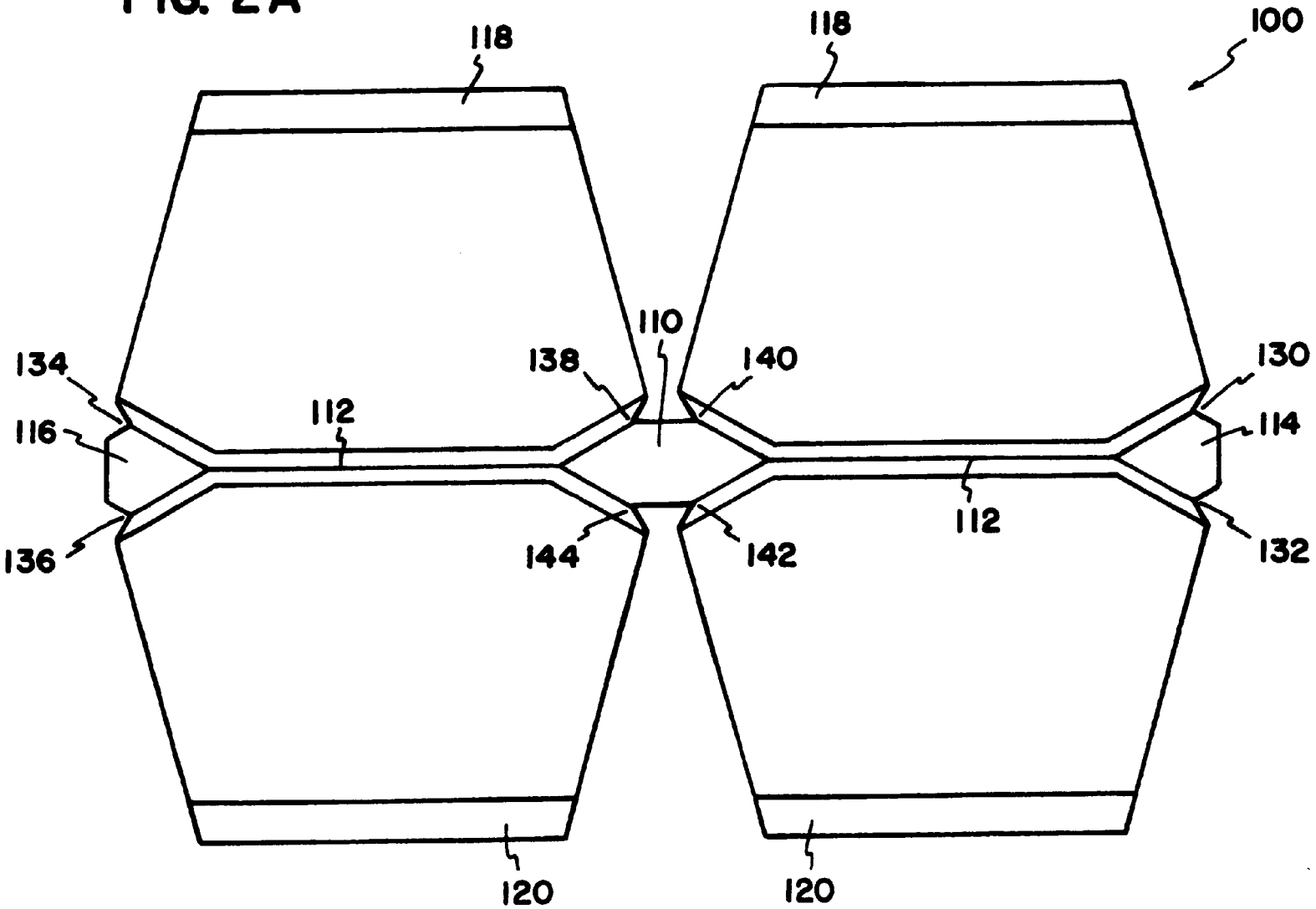
FIG. 2A is a plan view of the top, or "lips-up", side of a pre-split concrete masonry unit according to an additional aspect of my invention.
Figure 2B:
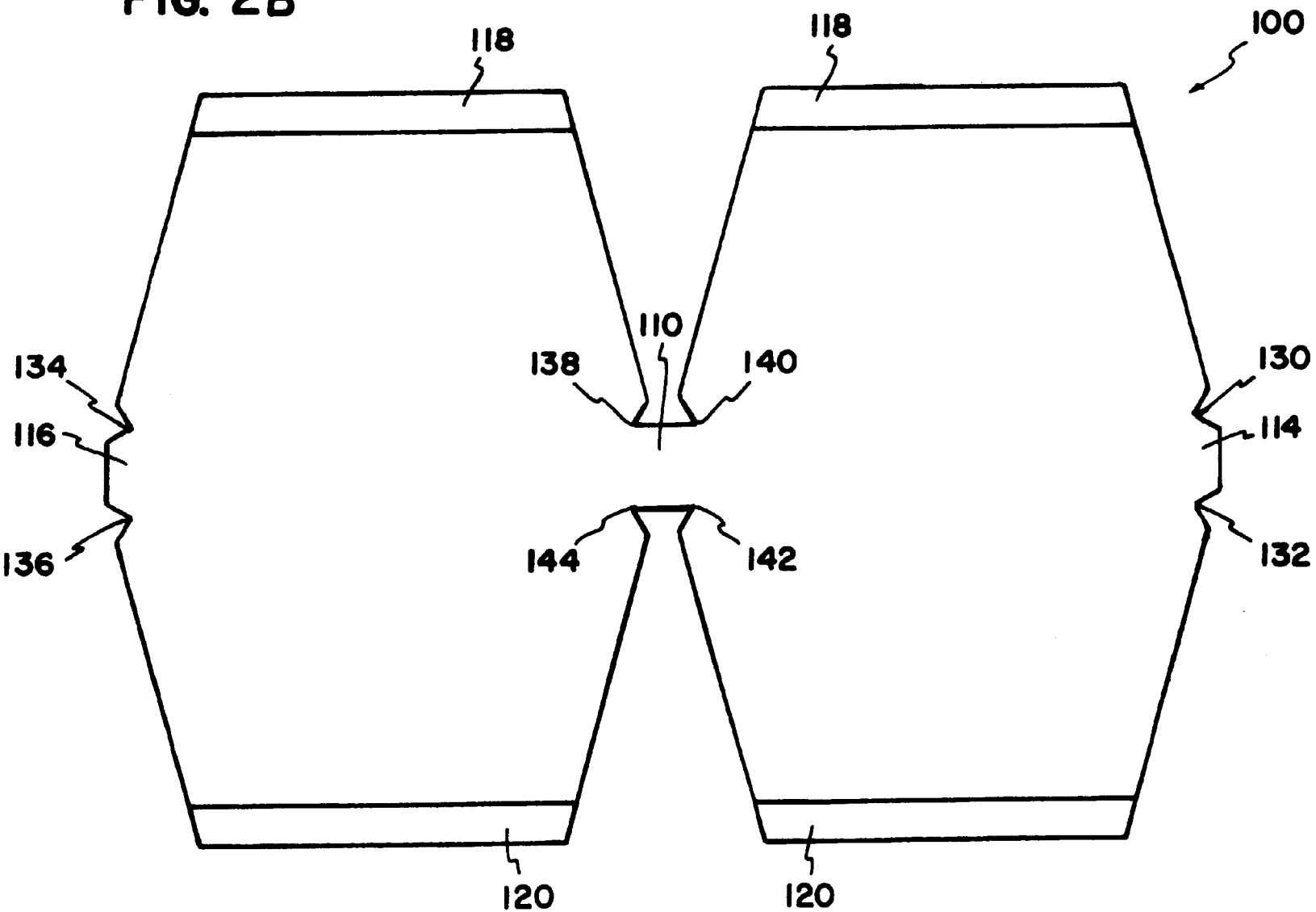
FIG. 2B is a plan view of the top, or "lips up", side of a pre-split concrete masonry unit according to a further alternative aspect of my invention.
Figure 3:
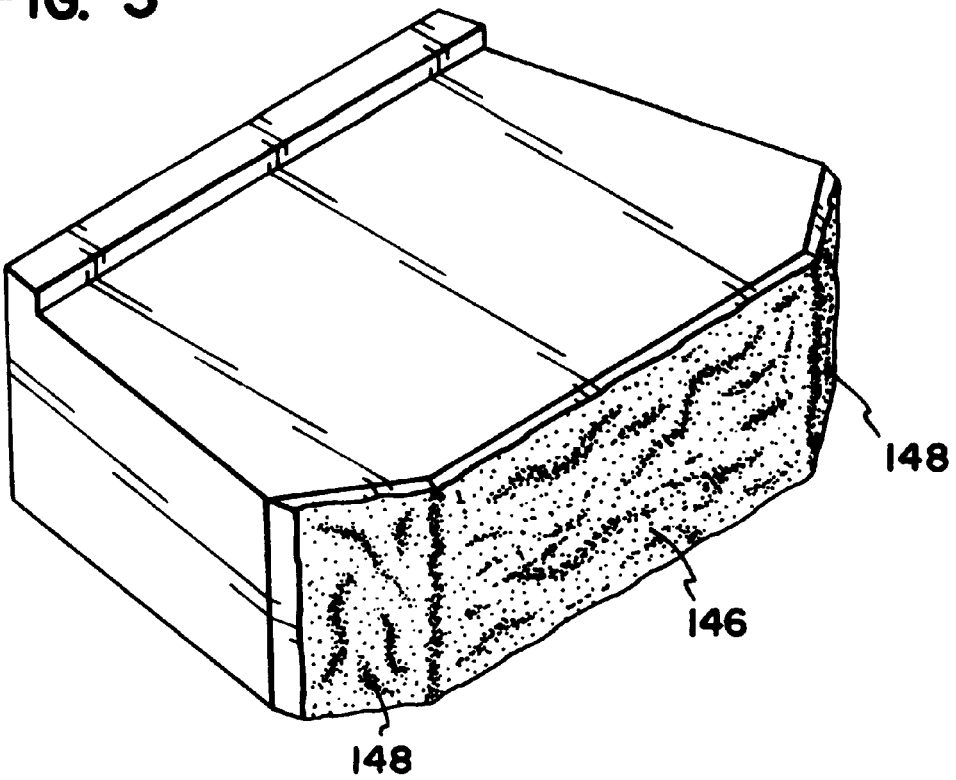
FIG. 3 is a perspective view of the "lips-up" side of a finished retaining wall block according to my invention showing the chamfer formed by the splitting pattern.

I have found that the size of web 110 as well as pieces 114 and 116 resulting from the splitting of unit 100 shown in FIG. 2B is substantially similar to the size of these pieces after splitting the unit of FIG. 2A.

Figure 4:
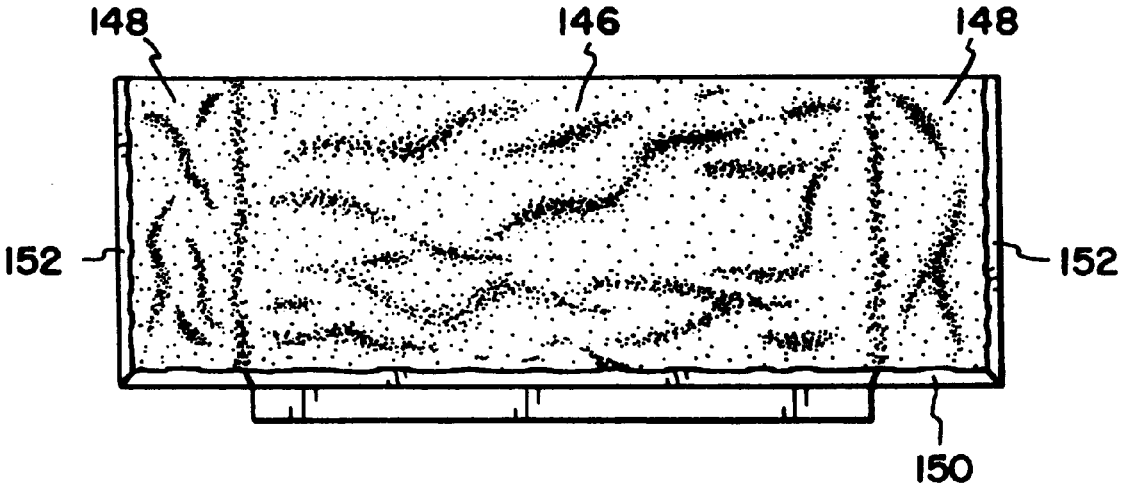
FIG. 4 is a front elevation of the finished retaining wall block shown in FIG. 3.
Figure 5:
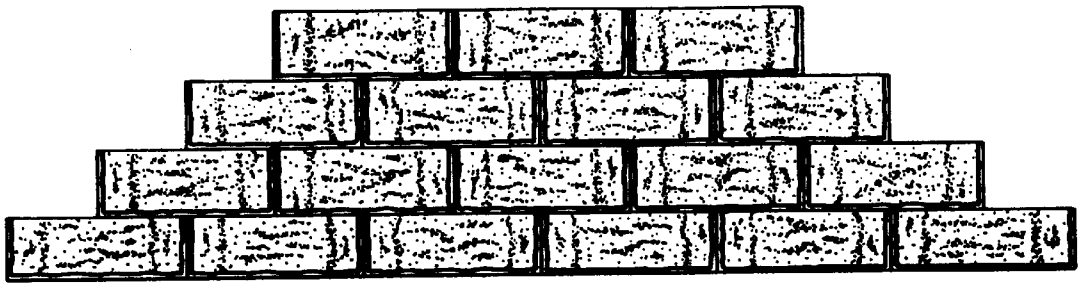
FIG. 5 is a front elevation of a retaining wall using the block shown in FIG. 3.

By using these techniques, I have found that I can consistently produce four of our ANCHOR WINDSOR STONE® units with one stroke of the splitter. The finished units have a face height of about four inches and a face width of about twelve inches. The center section 146 of the face is about eight inches in width, and the projected width of each return section 148 is about two inches, FIG. 4. The splitting action creates broken surfaces on the center and return faces of the block. In the case where the splitting groove 112 is employed there will be chamfer regions 150, 152 along the lower and side edges of the front face. This chamfer 150 is formed by the remnant of the splitting pattern. When this block is oriented as it would be when laid up in a wall, the wall has the appearance shown in FIG. 5. If the presplit unit of FIG. 2B is employed, there will be no chamfer 150 on the finished units. I believe this technique of employing a web 110 can also be successfully used to produce six finished WINDSOR®-sized units with one stroke of a splitter. In that case, three double slugs would be tied together in side-by-side relationship by using two webs 110 and a suitable blade assembly.

I know of no reason why the technique will not work with asymmetric pre-split units which are designed to produce one long unit and one short unit with essentially identical faces, or with an asymmetric pre-split unit, which is designed to produce one finished unit, and a sacrificial piece.

Figure 6:
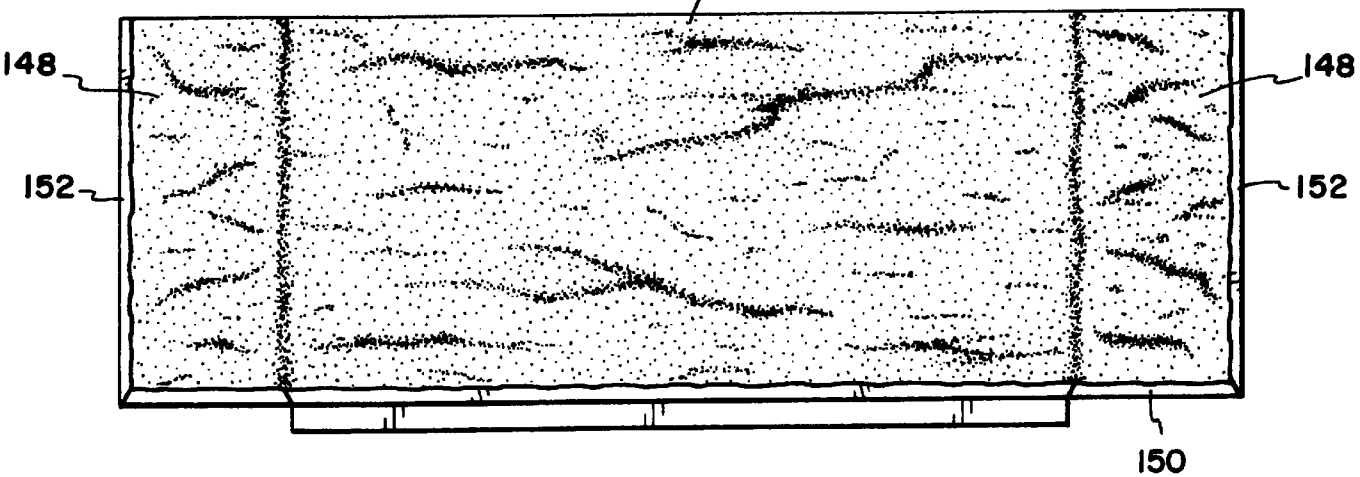
FIG. 6 is a front elevation of a Diamond® block made using my invention according to that aspect of the invention shown in FIG. 3.

By using this splitting pattern technique, I have found that I can consistently produce two of our ANCHOR DIAMOND® units (six inches tall), having an extended center section 146 of twelve inches and returns 148 having a projected width of about two inches each, with minimal hand dressing of the units needed. The finished unit is shown in FIG. 6.

Figure 7:
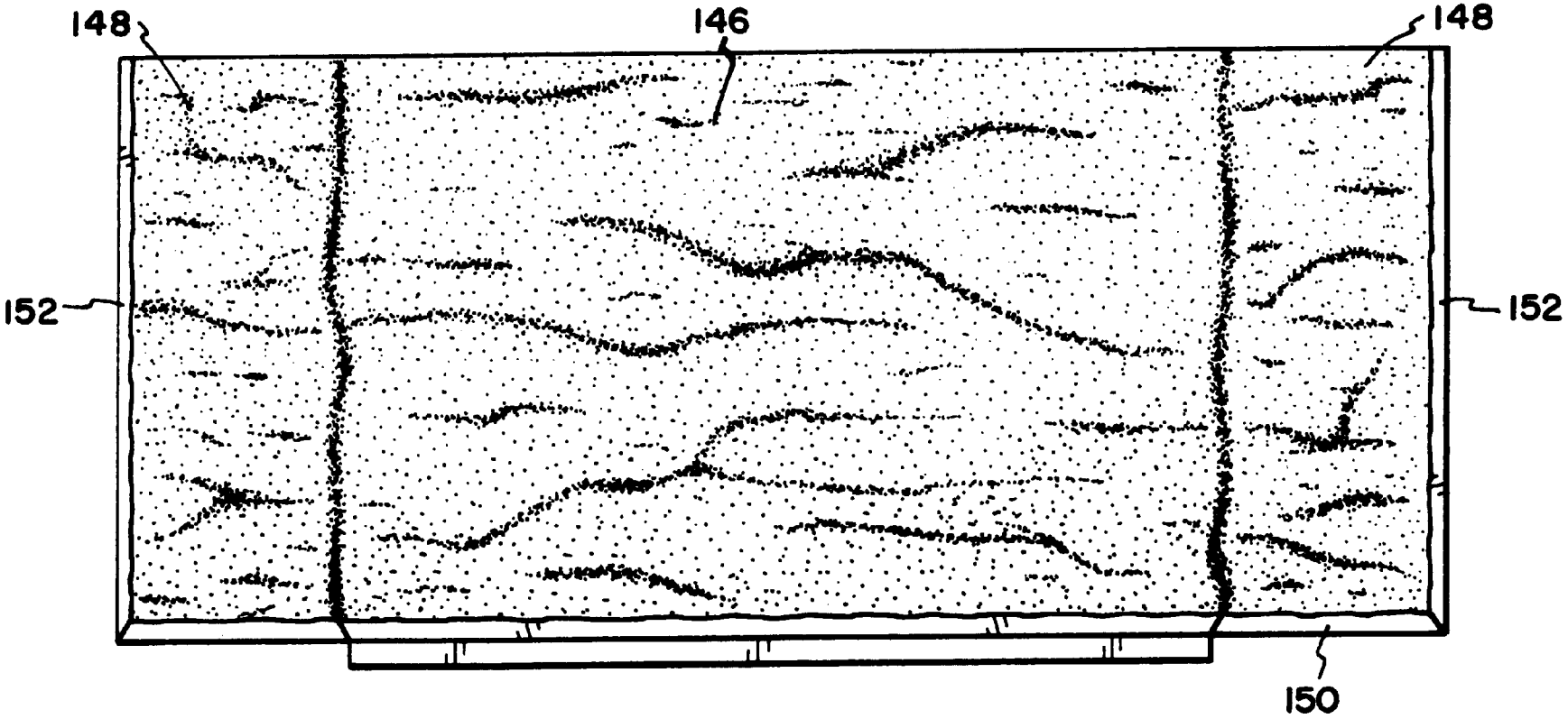
FIG. 7 is a front elevation of a Diamond Pro® block made using my invention according to that aspect of the invention shown in FIG. 3.

By using this splitting pattern technique, I believe that I can consistently produce two of our DIAMOND PRO™/ units (eight inches tall), having an extended center section 146 of twelve inches and returns 148 having a projected width of about three inches each, with minimal hand dressing of the units needed. The finished unit is shown in FIG. 7.

Figure 8:
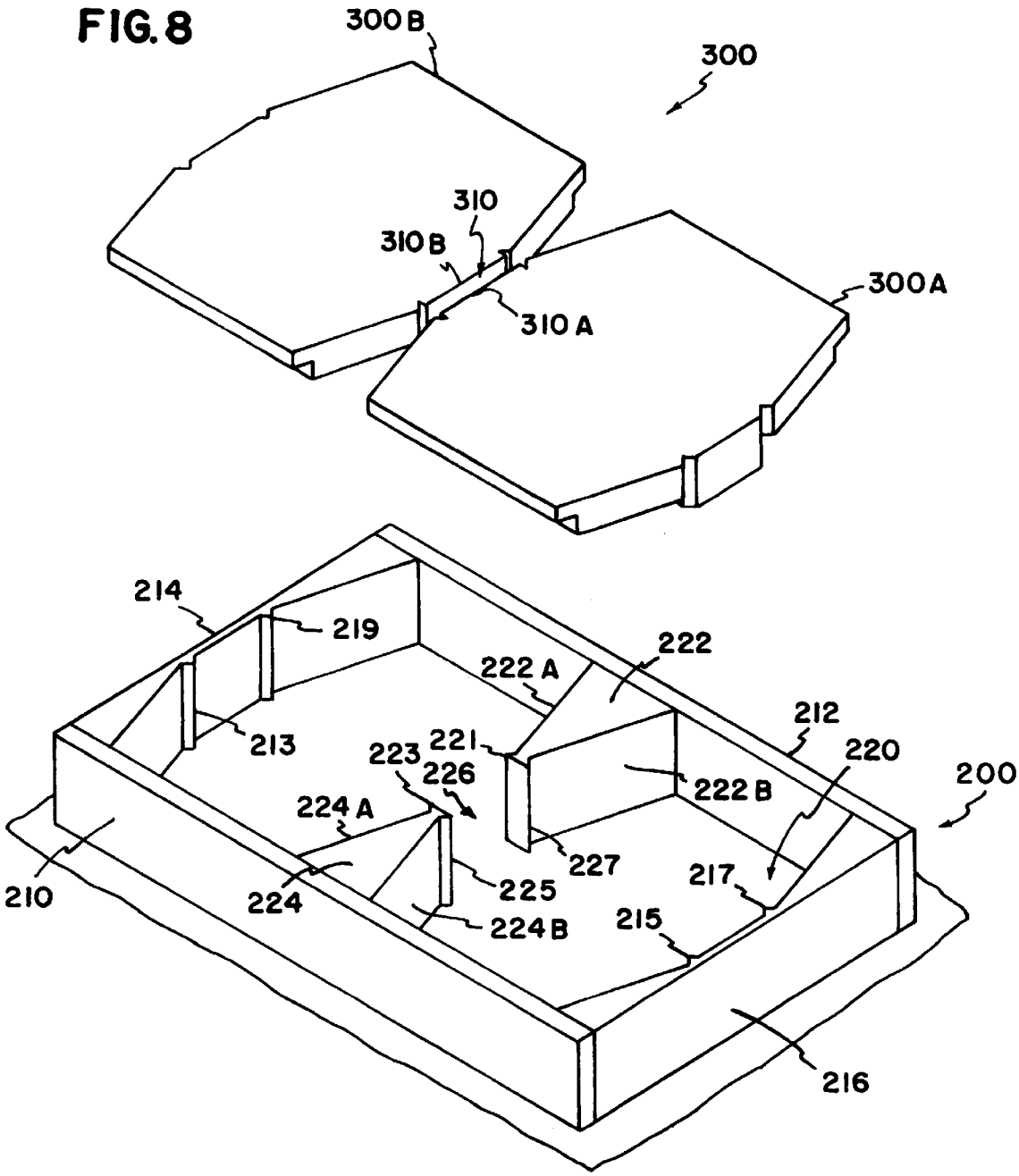
FIG. 8 is an exploded perspective view of a mold assembly in accordance with my invention.

The mold or mold box 200 may be configured to produce a single CMU, see FIG. 1, or a pair of CMU's, see FIG. 2, which are centrally joined until split. The mold shown in FIG. 8 may be used for the production of CMU's. The mold 200 generally comprises at least four sides defining a central cavity 220. As can be seen in FIG. 8, the mold generally has a front wall 210, a back wall 212, and first 216 and second 214 opposing sides or end plates. The central cavity 220 is bordered by these walls.

The mold functions to facilitate the formation of the blocks. Accordingly, the mold may comprise any material which will withstand the pressure to be applied to block fill by the head. Preferably, metals such as steel alloys having a Rockwell "C"-scale ranging from about 60–65 provide optimal wear resistance and the preferred rigidity. Generally, metals found useful in the manufacture of the mold of the present invention include high grade carbon steel 41-40 AISI (high nickel content, prehardened steel), carbon steel 40-0 (having added nickel) and the like. A preferred material includes carbon steel having a structural ASTM of A36.

The mold of the invention may be made by any number of means known to those of skill in the art. Generally, the mold is produced by cutting the stock steel, patterning the cut steel, providing an initial weld to the patterned mold pieces and heat treating the mold. Heat treating generally may take place at temperatures ranging from 1000° F. to 1400° F. for 4 to 10 hours depending on the ability of the steel to withstand processing and not distort. After heat treating, final welds are then applied to the pieces of the mold.

The mold walls generally function according to their form by withstanding the pressure created by the stripper shoe assembly. Additionally, the mold walls function to ensure that uniform pressure is applied throughout the entire block during formation. Further, the walls generally guide the height, width and depth of the resulting blocks. Accordingly the mold walls must be made of a thickness which will accommodate the processing parameters of block formation given a specific mold composition. Preferably, the mold walls range in thickness from about 0.25 inch to about 2.0 inches, preferably from about 0.75 inch to 1.5 inches.

During the molding of a double CMU piece, FIG. 8, the fill may be separated by division plates such as first 222 and second 224 partition members between which extends an opening 226. The sidewalls 222A and 222B of the first partition 222 and the sidewalls 224A and 224B form the respective sides of the two CMU seen in FIG. 2. Within opening 226 the web 110 (FIG. 2) forms connecting one CMU to the other.

Preferably, the mold 200 further comprises splitting ridges. Once the block is molded, and preferably cured, the splitting ridges assist during the splitting process in creating splits which define the individual blocks. As can be seen in FIG. 8, one embodiment of my invention shows first 215 and second 217 splitting ridges on the first side 216 of the mold. The second side 214 of the mold preferably also has a first 213 and second 219 splitting ridges. The splitting ridges may span from the mold bottom surface to the mold top surface. If the mold is used to form a double CMU, first 222 and second 224 partitions also preferably have splitting ridges which span from the mold bottom surface to the mold top surface. Here again, the first partition 222 splitting ridges 221 and 227 are preferably positioned opposite respective splitting ridges 219 and 217 on the first and second sides. The second partition 224 splitting ridges 223 and 225 preferably have a similar orientation to respective ridges 213 and 215.

The stripper shoe plate assembly 300 generally functions with the mold 200 in forming the masonry units of the invention. In order to form two CMU's which are joined by a central web 110, the two stripper shoe plates 300A and 300B preferably each have a centered edges 310A and 310B which lie adjacent each other in a configuration 310 which complements opening 226 lying between first 222 and second 224 partitions in the mold 200.

Figure 9:
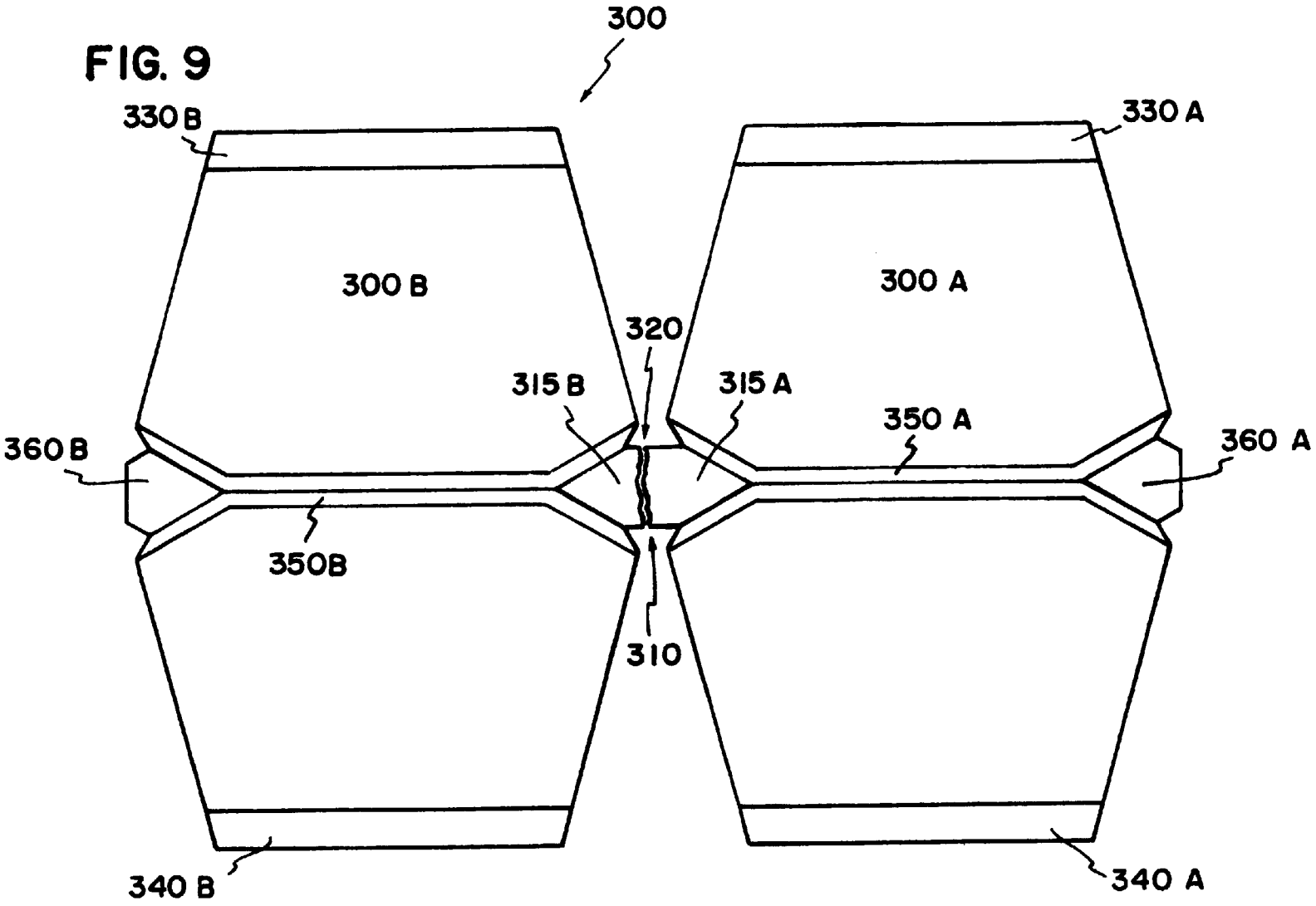
FIG. 9 is a bottom plan view of one embodiment of a stripper shoe plate according to one aspect of my invention.

One embodiment of a stripper shoe assembly 300 in accordance with my invention may be seen in FIG. 9. Stripper shoe plates 300A and 300B are not joined. Preferably, shoe plate piece 315A converges toward shoe plate piece 315B separated by a small opening 320. As can be seen, shoe piece 315A may extend farther toward shoe plate piece 315B. Alternatively, shoe pieces 315A and 315B may extend toward each other an equal distance.

Figure 10:
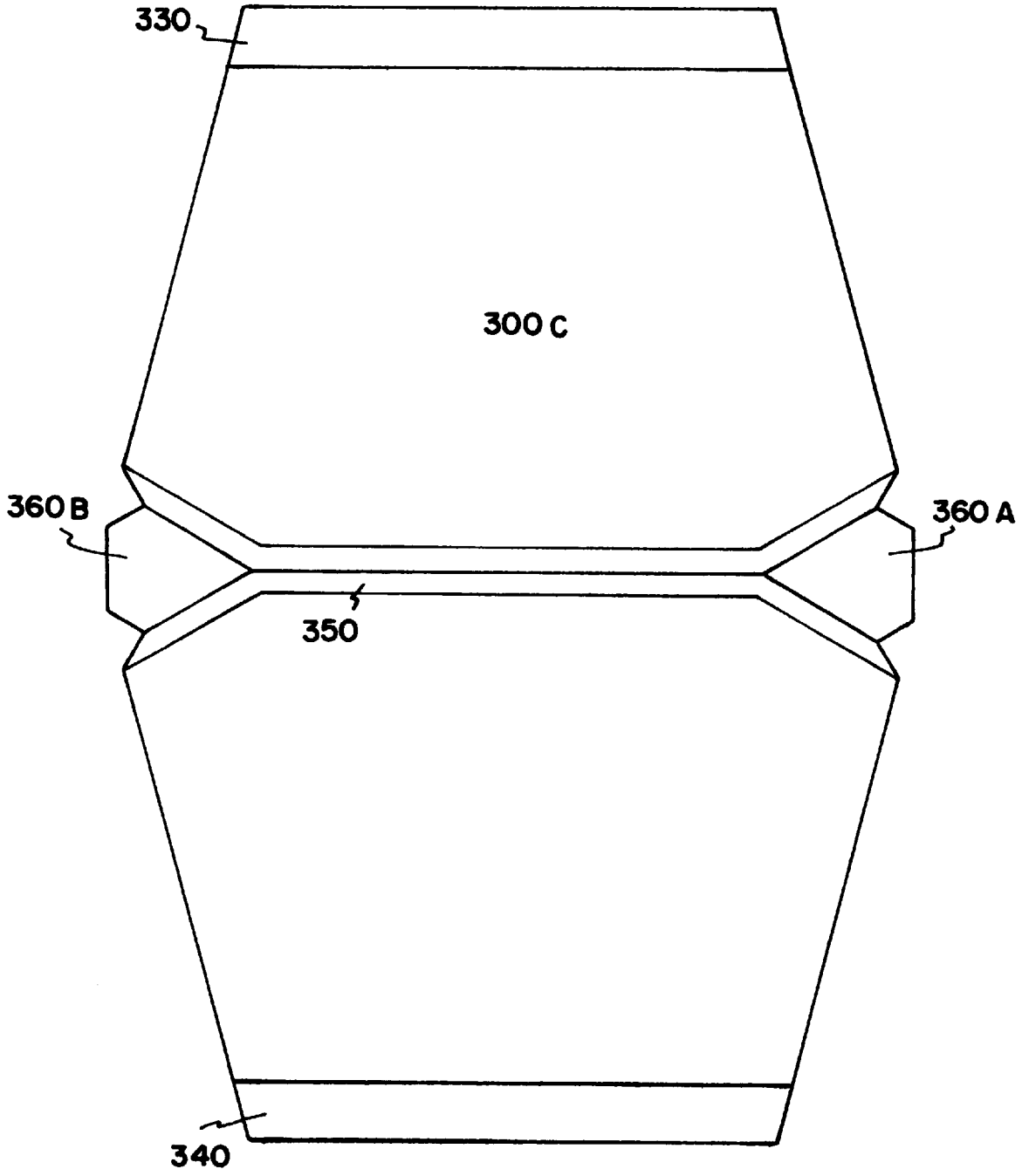
FIG. 10 is a bottom plan view of a further embodiment of a stripper shoe plate according to an alternative aspect of my invention.
Figure 11:
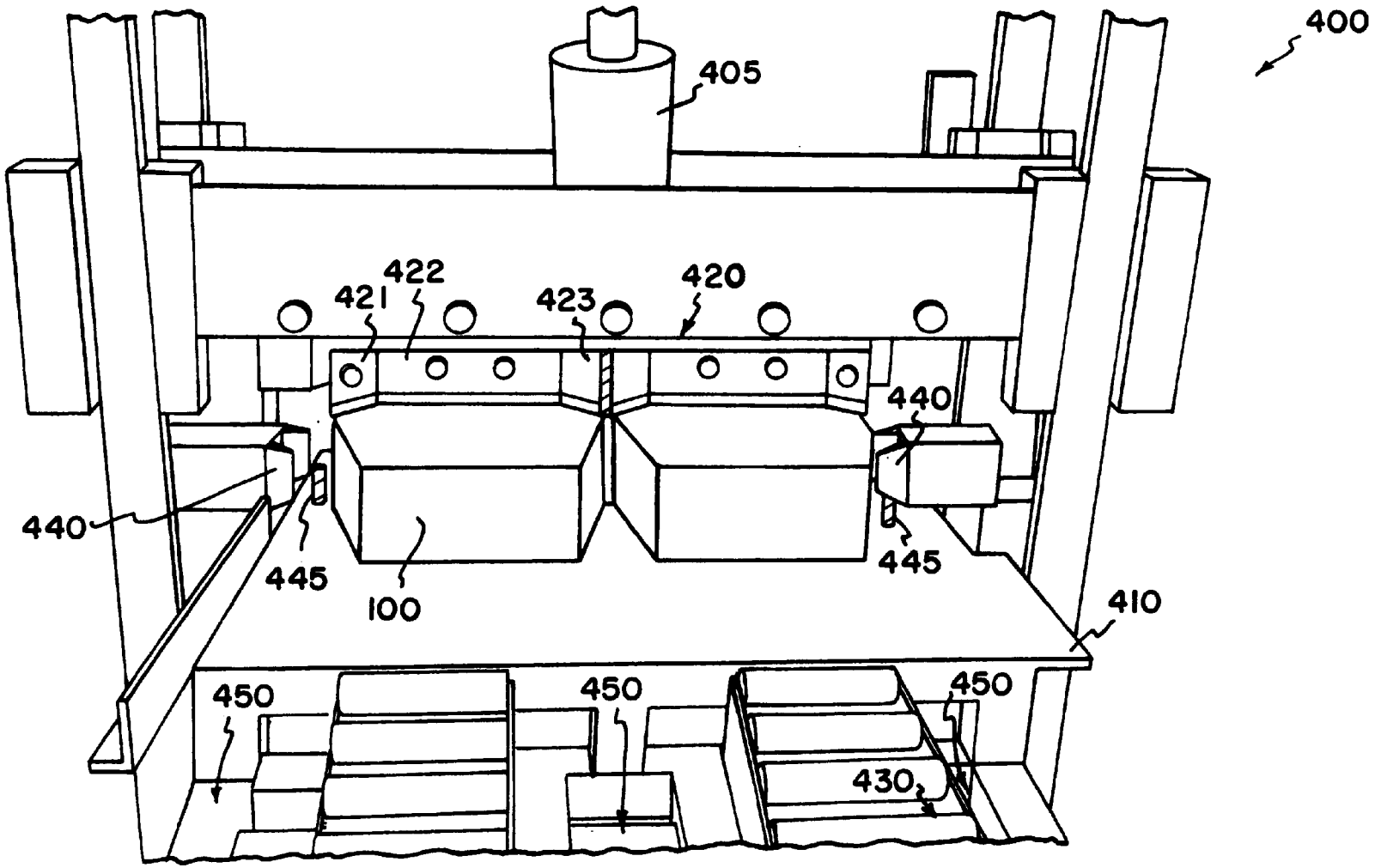
FIG. 11 is a perspective view of a block splitting machine and conveyor system useful in splitting and transporting block in accordance with a further aspect of my invention.

Depressions 330A and 330B as well as 340A and 340B, seen in FIGS. 9 and 10, complement raised flange portions 118 and 120 of the two CMU's. Shoe plate pieces 315A and 315B complement the central web 110 portion as is seen in FIG. 2. Further, raised portions 350A and 350B complement the splitting grooves 12 (FIG. 1) and depressed regions 14 and 16 in the formed CMU.

As can be seen in FIG. 9, raised splitting regions 315A, 315B, 360A and 360B are configured at the side edges of the bottom surface of each stripper shoe plate 300A and 300B. Splitting regions may be triangular in shape. The raised surface also may comprise a splitting ridge 350A and 350B. If a pre-split unit of the type shown in FIG. 2*a* is to be produced, raised regions 315A, 315B, 350A, 350B, 360A, and 360B are not included on the stripper shoeplate. The splitting ridge may define an axis of symmetry for each of the splitting regions and may also define an approximate axis of symmetry of the bottom surface of the stripper shoe 300A or 300B.

FIG. 10 illustrates a stripper shoe plate 300C which may be used to make a single CMU with a mold similar to that seen in FIG. 8. Again, the same portions of the stripper shoe complement those elements formed in the single CMU shown in FIG. 1.

To split the blocks shown in FIGS. 1, 2A, and 2B, a splitter 400 may be used to form the finished units in accordance with the invention. The general configuration with this splitter is well-known in the industry and is commercially available from Lithibar Matik and other commercial manufacturers of splitters. The splitter 400 generally comprises one or more hydraulic pistons 405 which actuate arms that hold the top and bottom splitting blade assemblies 420 and side knives 440. The splitter also comprises a table 410 which is used to support the concrete masonry unit 100 and center the unit in relationship to the top 420 and bottom 425 splitting blade assemblies and side knives 440, FIG. 12.

Figure 12:
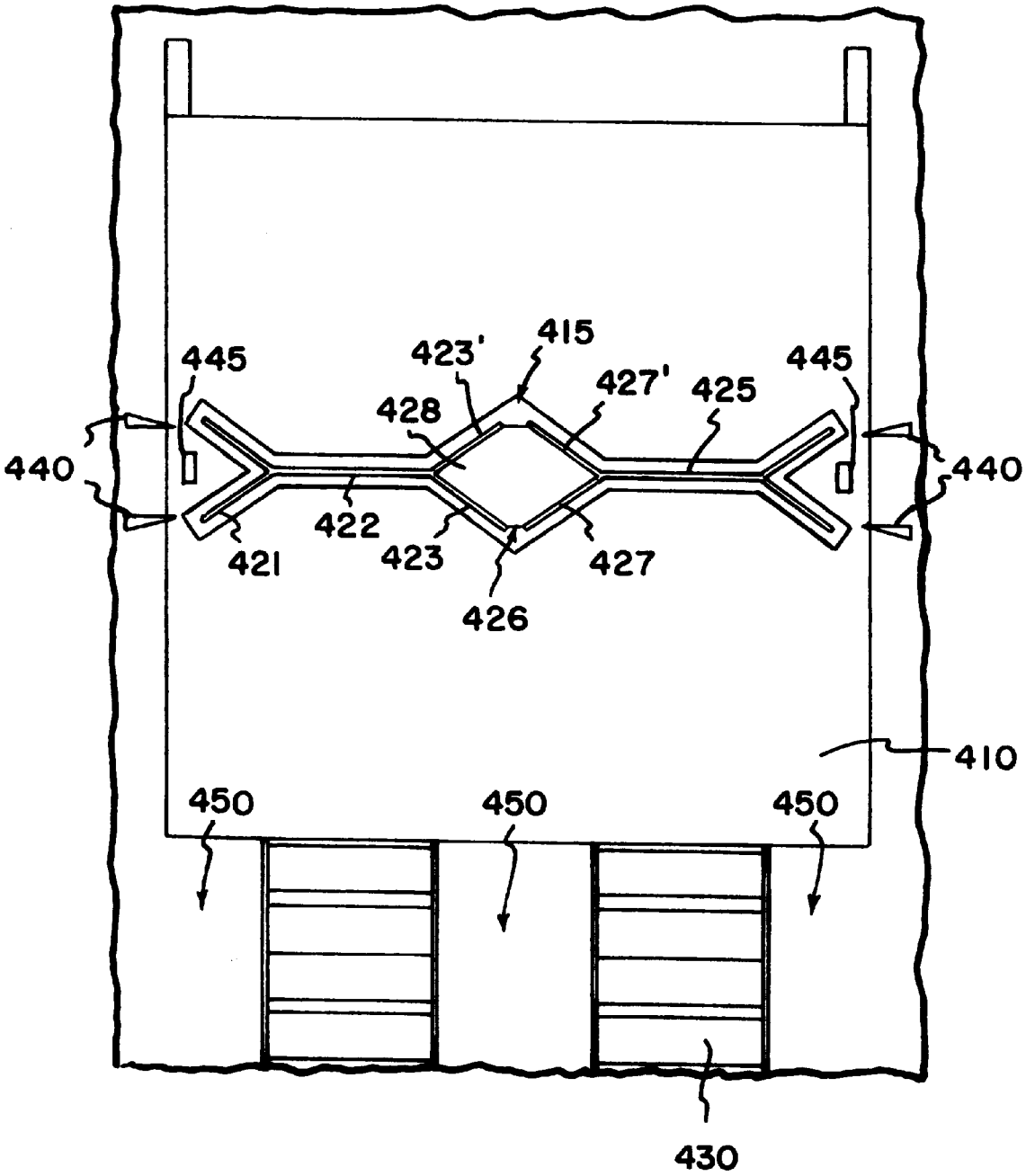
FIG. 12 is a plan view of the block splitter depicted in FIG. 11, depicting the splitter table, bottom splitter blade and conveyor of my invention.

Side rails 445, FIG. 12, are used to guide the blocks into the splitting station 400 and position the blocks from left to right. These side rails 445 also aid in clearing debris that may get stuck in side knives 440. Generally, the side rails are short pieces of metal, such as keystock, attached to the splitting table 410 in the region of the side knives 440. The rails are shorter than the spacing between the side knives 440. When the side knives 440 retract, any debris caught in the side knives 440 may be cleared by the side rails 445.

The top 420 and bottom 425 splitting blade assemblies may be assembled from various component knives such as 421, 422, and 423 which are bolted to the arm of the splitter 400.

The blade knives 421, 422, and 423 are actually sections bolted to a support plate (not shown) which, in turn, is attached to the splitter powered by piston 405. As noted, the splitter blade assembly has a plurality of blade sections 421, 422, and 423 which bound the opening into which stop 428, (FIG. 12), is fitted. The blade assembly 420 may be unitary in structure. Preferably, the blade assembly comprises a number of component knives, as described above. These component knives generally comprise two crow's foot blades 423, 423' and 427, 427' mounted side-by-side, FIG. 12. These blades 423, 423' and 427, 427' bound an opening. Blades 423, 423' and 427, 427', respectively, are not unitary in this embodiment of the invention.

In use, the blocks are passed onto the splitting table by an automated conveyor which is synchronized to the action of the blade. This conveyor may also be used to push split block out of the splitter machine. The pattern of the top splitting blade 420 corresponds to the pattern of the bottom splitting blade 425. The bottom splitting blade 425 comes up to contact the unit 100 through an opening 415 in the table 410, FIG. 12. In operation, a concrete masonry unit 100 passes into the splitter 400 and is centered between the top 420 and bottom 425 splitting blades. Side knives 440 extend by pistons to contact the unit 100 at the side grooves 130, 132, 134, and 136 shown in FIGS. 2A and 2B.

Splitting is completed and the finished blocks then pass out of the splitter 400 onto conveyor 430. Depending upon whether the unit to be split takes the form of that shown in FIG. 1 or FIGS. 2A and 2B the conveyor may comprise a single set of rollers or additional sets of rollers 430 as shown in FIG. 12. Preferably, the rollers used to pass blocks from the splitter 400 have a width which is slightly less than the width of the finished, split blocks. This allows waste from the concrete masonry unit 100 which does not form the finished split blocks to fall away from, or off of, the blocks into openings 450.

A suitable conveyor (not shown) can be positioned to catch the waste chunks which fall into the openings 450 and transport them to a waste pile. Additionally, in splitting, I have found that the web section 110, FIGS. 2A and 2B, of the concrete masonry unit 100 has a tendency to lodge in the opening 426, defined by the top 420 and bottom 425 splitting blades, see for example FIG. 12. To facilitate rapid production, without stopping the splitter 400 to remove the split out web portion, I have inserted an elastomeric stop 428, FIG. 12 into the opening in the upper and lower blades. This stop 428 may be made of any composition such as natural or synthetic rubber, thermoplastic polymers, or synthetic polymers and mixtures thereof. When used, split off waste products do not lodge in the openings between the blades and thus do not prevent further splitting. Generally, the splitting station comprises an upper blade and a lower blade which are similarly configured and both preferably contain a stop 428 in their respective openings.

I have found, by using the splitting pattern technique, that I can achieve a more subtle, aesthetically-pleasing look on our taller blocks, (DIAMOND and DIAMOND PRO™) due to our ability to make the shorter return facets. I have also found that the unbroken remnant of the splitting pattern which remains on the finished faces creates a pleasing chamfer on the lower and side edges of the finished faceted face. I have found that this chamfer, in combination with the shorter returns and the course-to-course setback when the blocks are formed into a wall, creates a unique look that has not heretofore been achieved in faceted retaining walls. I have also found, by using the attaching web technique, that I can significantly speed up and improve the splitting operation.

The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A splitter blade assembly adapted to form split faces on concrete masonry units, said assembly comprising:

a.) a blade having a first end and a second end with a plurality of blade sections arranged between the first and second ends;

b.) the plurality of blade sections arranged to bound an opening intermediate the first and second ends of said blade; and c.) a stop positioned within the opening so as to prevent debris from lodging in the opening during a splitting operation.

2. The block splitter of claim 1, wherein said stop comprises an elastomeric material.

3. The block splitter of claim 1, wherein said stop comprises rubber.

4. The assembly of claim 1, wherein said assembly further comprises a splitting table.

5. The assembly of claim 4, wherein said assembly further comprises means for conveying split blocks off of said splitting table.

6. The assembly of claim 5, wherein said conveying means comprises a first conveyor and a second conveyor, said first and second conveyors separated by a zone for removal of splitting waste.

7. The block splitter of claim 6, wherein said first and second conveyors comprise rollers.

8. The assembly of claim 1, wherein the opening is square shaped.

9. The assembly of claim 1, wherein said blade sections are of unitary structure.

10. A splitter blade assembly, adapted to split an interior piece from a pre-split concrete masonry unit, said assembly comprising an upper blade, and a lower blade, each of said upper and lower blades having a first end and a second end with a splitting edge between said first end to said second end, said splitting edge having an opening, said splitting edge having a stop positioned in the opening.

11. The splitter of claim 10, wherein said stop comprises an elastomeric composition.

12. The splitter of claim 11, wherein said elastomeric composition comprises rubber.

13. The assembly of claim 10, wherein the opening is square shaped.

14. The splitter of claim 10, wherein the opening in each of said upper and lower blades is centrally located between said first end and said second end.

15. The splitter of claim 14, wherein said splitting edge comprises a first intermediate portion and a second intermediate portion, said first and second intermediate portions define the central opening in said splitting edge.

16. The splitter of claim 15, wherein said first and second intermediate portions of said splitting edge form a square shaped opening.

17. The splitter of claim 10, wherein said upper blade is of unitary structure.

18. The splitter of claim 10, wherein said lower blade is of unitary structure.

19. The splitter of claim 10, wherein said splitting edge is discontinuous.

20. A splitting station configured to split concrete masonry units, said splitting station comprising:

a.) a splitting table;

b.) a splitter blade assembly, adapted to split an interior piece from a pre-split concrete masonry unit, said assembly comprising an upper blade, and a lower blade, each of said upper and lower blades having a first end and a second end with a splitting edge between said first end to said second end, said splitting edge having an opening, said splitting edge having a stop positioned in the opening;

c.) first means for conveying a concrete masonry unit onto said splitting table; and d.) second means for conveying split concrete masonry unit off of said splitting table.

21. The station of claim 20, wherein said first conveying means comprises an automated conveyor.

22. The station of claim 20, wherein said second conveying means comprises a first conveyor and a second conveyor, said first and second conveyors separated by a zone for removal of splitting waste.

23. The station of claim 22, wherein said first and second conveyors comprise rollers.

24. The station of claim 20, wherein said splitting edge is discontinuous.

* * * * *